US006367129B1

(12) United States Patent
Mori

(10) Patent No.: US 6,367,129 B1
(45) Date of Patent: Apr. 9, 2002

(54) BUCKLE

(75) Inventor: Shinji Mori, Aichi-ken (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 0 days.

(21) Appl. No.: 09/508,393

(22) PCT Filed: Jul. 21, 1999

(86) PCT No.: PCT/JP99/03890

§ 371 Date: Mar. 13, 2000

§ 102(e) Date: Mar. 13, 2000

(87) PCT Pub. No.: WO00/05988

PCT Pub. Date: Feb. 10, 2000

(30) Foreign Application Priority Data

Jul. 27, 1998 (JP) ..... 10-211262

(51) Int. Cl.[7] ..... A44B 11/26

(52) U.S. Cl. ..... 24/641; 24/171; 24/633; 24/637

(58) Field of Search ..... 24/641, 633, 646, 24/637

(56) References Cited

U.S. PATENT DOCUMENTS 4,339,854 A * 7/1982 Ikesue ..... 24/641
5,274,890 A * 1/1994 Shimizu ..... 24/603
5,288,090 A * 2/1994 Templin et al. ..... 297/473
5,649,341 A * 7/1997 Ashline et al. ..... 24/171

FOREIGN PATENT DOCUMENTS

JP 63-238802 10/1988
JP 8-173213 7/1996

* cited by examiner

*Primary Examiner*—Victor N. Sakran
(74) *Attorney, Agent, or Firm*—Nixon Peabody LLP; Thomas W. Cole

(57) ABSTRACT

A buckle is provided in which a number of parts can be reduced and which can reliably maintain a latched state. When a tongue plate is engaged (latched) by a lock plate, presser members of a cam urged by a return spring abut receiving surfaces of the lock plate, and therefore, a latched state cannot be inadvertently released. Further, when the latched state is to be released, by pressing a release button, a claw is pushed such that a cam rotates, and the presser members separate from the receiving surfaces. As a result, the return spring is compressed, and due to elastic force of the return spring, the release button returns to its original position. In this way, because the return spring carries out both the operation of urging the cam and the operation of returning the release button to its original position, the number of parts is reduced.

2 Claims, 6 Drawing Sheets

BUCKLE

BACKGROUND OF THE INVENTION

1. Field of the Invention

The present invention relates to a buckle which engages with a tongue plate provided at a webbing of a seat belt device so as to maintain the webbing in an applied state.

2. Description of the Related Art

Conventional seat belt devices use a buckle which engages with a tongue plate so as to maintain a webbing in an applied state. The buckle includes, within a cover member, a buckle main body, a lock plate which engages with the tongue plate so as to be in a latched state, a release button which releases the latched state of the lock plate, an ejector which expels the tongue plate to the exterior by elastic force at the time the latch state is released, a lock pin for maintaining the latched state, and the like.

Simplification of the processes for manufacturing the buckle which is structured in this way is desired, and a reduction in the number of parts is desired from the standpoint of a reduction in costs.

Further, a mechanism which keeps the latched state of the lock plate to the tongue plate from being released even when an unplanned force is applied to the buckle is indispensable.

SUMMARY OF THE INVENTION

In view of the aforementioned, an object of the present invention is to provide a buckle in which the number of parts is reduced and which can reliably maintain a latched state.

A first aspect of the present invention is a buckle which engages with a tongue plate provided at a webbing in a seat belt device, comprising: a latch member engaging with the tongue plate which has been inserted to a predetermined position; a lock member abutting the latch member and maintaining an engaged state in which the latch member is engaged with the tongue plate; an operation member which, when operated, releases the lock member from the latch member; and a spring disposed between the operation member and the lock member, and urging the operation member to a pre-operation original position, and urging the lock member toward the latch member.

Operation of the first aspect will be described.

Due to the tongue plate being inserted in the buckle up to a predetermined position, the latch member engages the tongue plate so as to be in a latched state. At this time, the lock member, which is urged by the elastic force of the spring, abuts the latch member, and locks the latch member such that the latch member cannot be displaced from the engaged state. As a result, the latched state is maintained.

When the tongue plate is to be released from the buckle, by operating the operation member against the elastic force of the spring, the lock member separates from the latch member, and the locked state of the latch member is released. As a result, the engaged state of the latch member and the tongue plate is released, and the tongue plate is freed to the exterior, and the operation member is returned to its original position by the elastic force of the spring.

In this way, a single spring serves as both a spring for making the lock member abut the latch member and a spring for returning the operation member to its original position. Accordingly, the number of parts can be reduced, and the manufacturing process and assembly process can be simplified.

Further, because the latch member is locked by the lock member which is urged by the spring, the latched state is reliably maintained.

In a second aspect of the present invention, in the first aspect, the lock member is a freely rotating cam, and comprises: a first convex portion pushed in a lock releasing direction by operation of the operation member; and a second convex portion formed at a side of a center of rotation of the cam which is substantially opposite the side at which the first convex portion is disposed, an end of the spring engaging with the second convex portion, wherein a center of gravity of the cam is positioned toward the second convex portion.

Operation of the second aspect will be described.

When the latch member engages the tongue plate which has been inserted in the buckle up to a predetermined position (i.e., when the latched state is set), the lock member (cam) urged by the spring rotates, and the lock member (the second convex portion) abuts the latch member. As a result, the latch member is locked, and the latched state is maintained.

When the latched state is to be released, by operating the operation member, the first convex portion is pressed, and the lock member rotates in the lock releasing direction. As a result, the lock member separates from the latch member, and the locked state is released. As a result, the engaged (latched) state of the latch member and the tongue plate is released.

At this time, the operation member is returned to its original position due to the urging force of the spring.

The implementing and releasing of the latched state are carried out in this way. However, when an impact force in the lock releasing direction acts on the buckle, because the first convex portion and the second convex portion are disposed at substantially opposite sides of the center of rotation of the cam, rotational moments in opposite directions (the lock releasing direction and the direction opposite thereto) act on the first convex portion and the second convex portion. However, because the center of gravity of the lock member (cam) is positioned toward the second convex portion side, a rotational moment in the direction opposite to the lock releasing direction acts on the lock member. Accordingly, the latched state (locked state) of the buckle is not released due to the impact force, and is reliably maintained.

DESCRIPTION OF THE PREFERRED EMBODIMENTS

A buckle relating to an embodiment of the present invention will be described hereinafter with reference to FIGS. 1–6.

Figure 1:
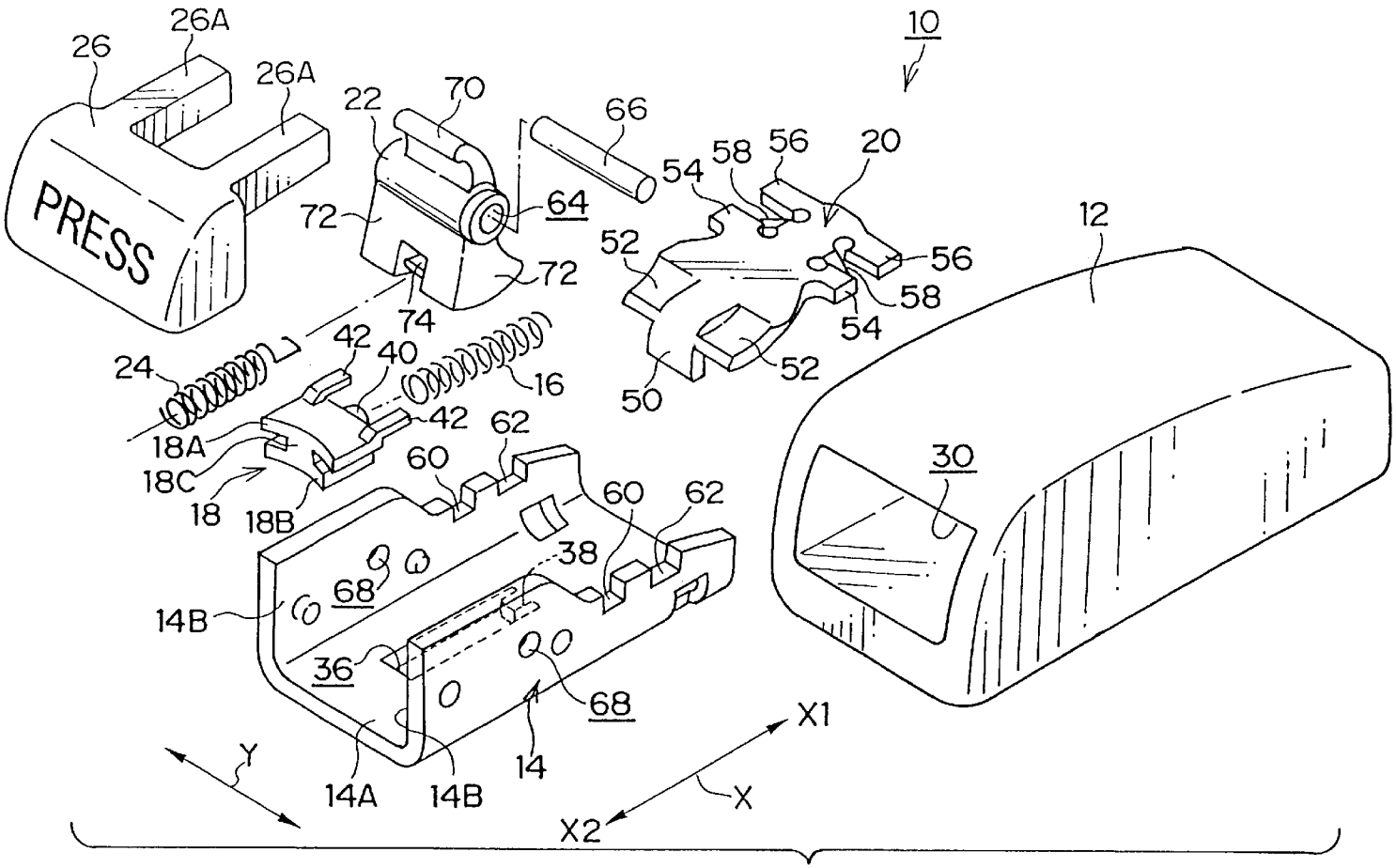
FIG. 1 is an exploded perspective view of a buckle relating to an embodiment of the present invention.

As illustrated in FIG. 1, the buckle 10 is formed from a cover member 12, a body 14, an ejector 18 which urges a tongue plate 80, which will be described later, toward the exterior by the elastic force of an ejector spring 16, a lock plate 20 which is in a latched state by engaging with the tongue plate 80, a cam 22 which abuts and moves away from the lock plate 20 so as to maintain or release the latched state, and a release button 26 which engages with the cam 22 due to a return spring 24 and is pressed at the time of releasing the latched state.

A through hole 30 is formed in the cover member 12. All of the aforementioned structural elements are disposed at the interior of the through hole 30.

Figure 2:
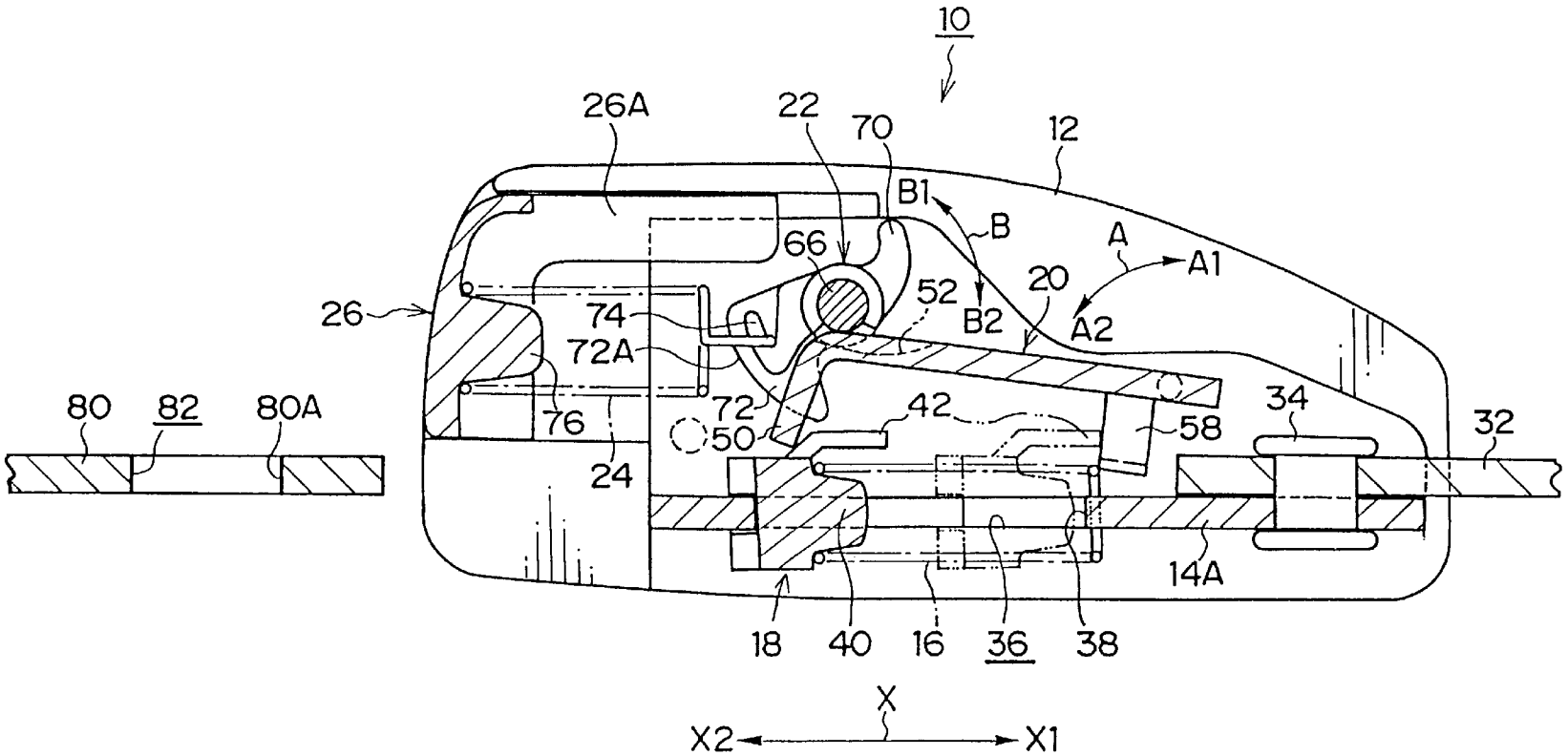
FIG. 2 is a cross-sectional view of main portions at a time the buckle relating to the embodiment of the present invention is free.

The body 14 is formed by a bottom surface 14A and a pair of side surfaces 14B which are formed integrally with the bottom surface 14A at the both sides thereof, such that the body 14 is formed in a substantial U-shape. As illustrated in FIG. 2, the bottom surface 14A of the body 14 is connected, via a rivet joint 34, to an anchor plate 32 which is inserted from one end (the arrow X1 direction end portion; hereinafter, the arrow X1 direction will be referred to as the X1 direction) of the through hole 30 (see FIG. 2). A hole 36 for sliding for the ejector 18 is formed in the bottom surface 14A.

The ejector 18 has a configuration in which a top plate 18A and a bottom plate 18B are connected together by a connecting portion 18C which is thinner than both. Accordingly, due to the connecting portion 18C of the ejector 18 being inserted into the hole 36 for sliding of the body 14, the top plate 18A abuts the upper side of the bottom surface 14A, and the bottom plate 18B abuts the bottom side of the top surface 14A. Namely, the ejector 18 is structured so as to slide freely along the longitudinal direction (the X direction) of the hole 36 for sliding. The ejector spring 16 is disposed between a projection 40 formed at the rear surface (the X1 direction side) of the ejector 18 and a projection 38 formed at the X1 direction end portion of the hole 36 for sliding. The ejector spring 16 always urges the ejector 18 in the arrow X2 direction (hereinafter referred to as the X2 direction).

A pair of supporting portions 42 for supporting the lock plate 20 are formed at the rear (X1 direction) of the upper portion of the both transverse (Y) direction end portions of the ejector 18.

At the central portion in the transverse direction (Y direction) at the front end portion (X2 direction end portion) of the lock plate 20, an engaging portion 50, which is bent downward substantially 90° as viewed from the side, is formed, and a pair of receiving surfaces 52, at which are formed downwardly convex circular arc-shaped surfaces as seen from the side, are formed at the both transverse direction sides of the engaging portion 50. Further, pairs of supporting plates 54, 56 and engaging plates 58 formed so as to be slanted downward are formed at both transverse (Y) direction end portions of the rear end portion (X1 direction end portion) of the lock plate 20.

The supporting plates 54, 56 of the lock plate 20 are inserted into pairs of concave portions 60, 62 provided at both side surfaces 14B of the body 14. The lock plate 20 is swingable in the directions of arrow A (see FIGS. 2 and 3) with this region as the center of swinging.

The cam 22 is disposed at the top portion of the lock plate 20. A shaft 66 inserted through a hole 64 is supported at holes 68 formed in the both side surfaces 14B of the body 14, such that the cam 22 is supported so as rotate freely in the directions of arrow B (see FIGS. 2 and 3).

A claw 70 is formed at the top side of the cam 22. In the latched state, the claw 70 abuts the release button 26 which will be described later.

At the bottom side of the cam 22 (the opposite side approximately 180° from the claw 70 in the B direction), a hook 74, with which one end of the return spring 24 is engaged, is formed at the transverse (Y) direction center, and a pair of presser members 72, having presser surfaces 72A of configurations (circular-arc-shaped surfaces as seen from the side) corresponding to the receiving surfaces 52 of the lock plate 20, are formed at the transverse (Y) direction both sides. One end of the return spring 24 is engaged with the hook 74, and the other end of the return spring 24 is engaged with a convex portion 76 (see FIGS. 2 and 3) of the release button 26.

Figure 4:
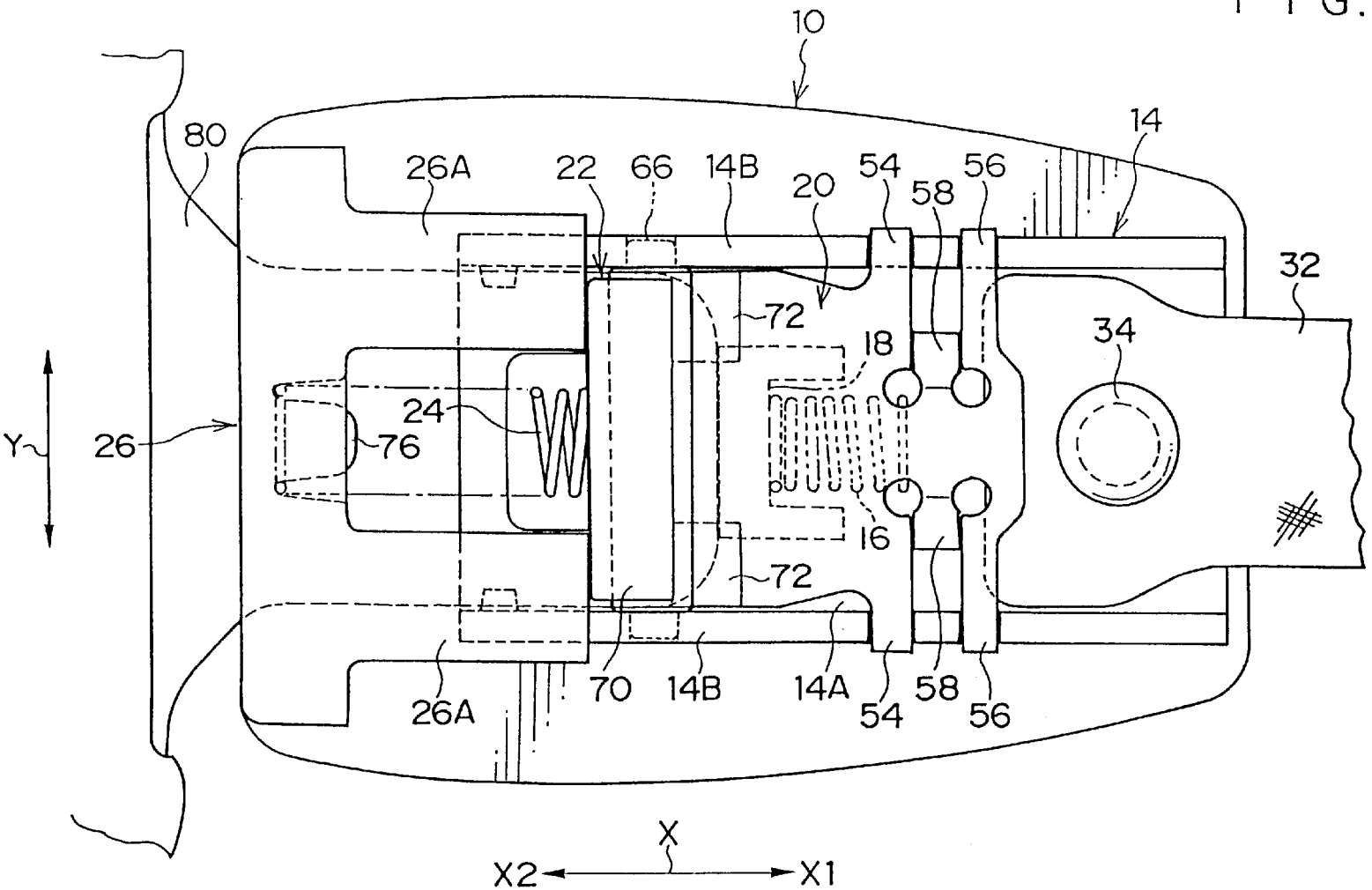
FIG. 4 is a plan view of main portions at the time the buckle relating to the embodiment of the present invention is latched.

As illustrated in FIG. 4, the release button 26 is provided with a pair of protrusions 26A which slide on the top surfaces of the both side surfaces 14B of the body 14. The end portions of the protrusions 26A abut the claw 70 of the cam 22 at the time of latching.

An engaging hole 82 for engaging the lock plate 20 is formed in the front end portion (X1 direction end portion) of the tongue plate 80 which is inserted into the buckle 10.

Operation of the buckle 10 which is structured in this manner will be described.

The state of the buckle 10 before the tongue plate 80 has entered therein is illustrated in FIG. 2.

At this time, because the ejector 18 is always urged in the X2 direction by the ejector spring 16, the ejector 18 is positioned at the X2 side end portion of the hole 36 for sliding. Accordingly, as illustrated in FIG. 2, at the lock plate 20, the engaging portion 50 is supported by the inclined surfaces forming the supporting portions 42 of the ejector 18, and the lock plate 20 is in a state of having been rotated in the arrow A1 direction (hereinafter referred to as the Al direction) with portions of the supporting plates 56 as the center of rotation. The lock plate 20 abuts the shaft 66 of the cam 22.

In this state, the tongue plate 80 is inserted from the X2 direction side of the through hole 30 of the cover member 12. Namely, the tongue plate 80 presses the ejector 18 in the X1 direction, and the enters in the direction of X1 while compressing the ejector spring 16. At this time, the supporting portions 42 of the ejector 18 separate from the engaging portion 50 of the lock plate 20 as the ejector 18 moves in the X1 direction.

Due to the distal ends of the supporting portions 42 abutting the engagement plates 58 of the lock plate 20 due to movement of the ejector 18 (refer to the two-dot chain line portion in FIG. 2), the engagement plates 58 are pressed in the X1 direction. Namely, a counterclockwise (arrow A2 direction, hereinafter referred to as A2 direction) moment around the supporting plates 56 is generated at the lock plate 20, and the engaging portion 50 is inserted into the engaging hole 82 of the tongue plate 80 (see FIG. 3).

Figure 3:
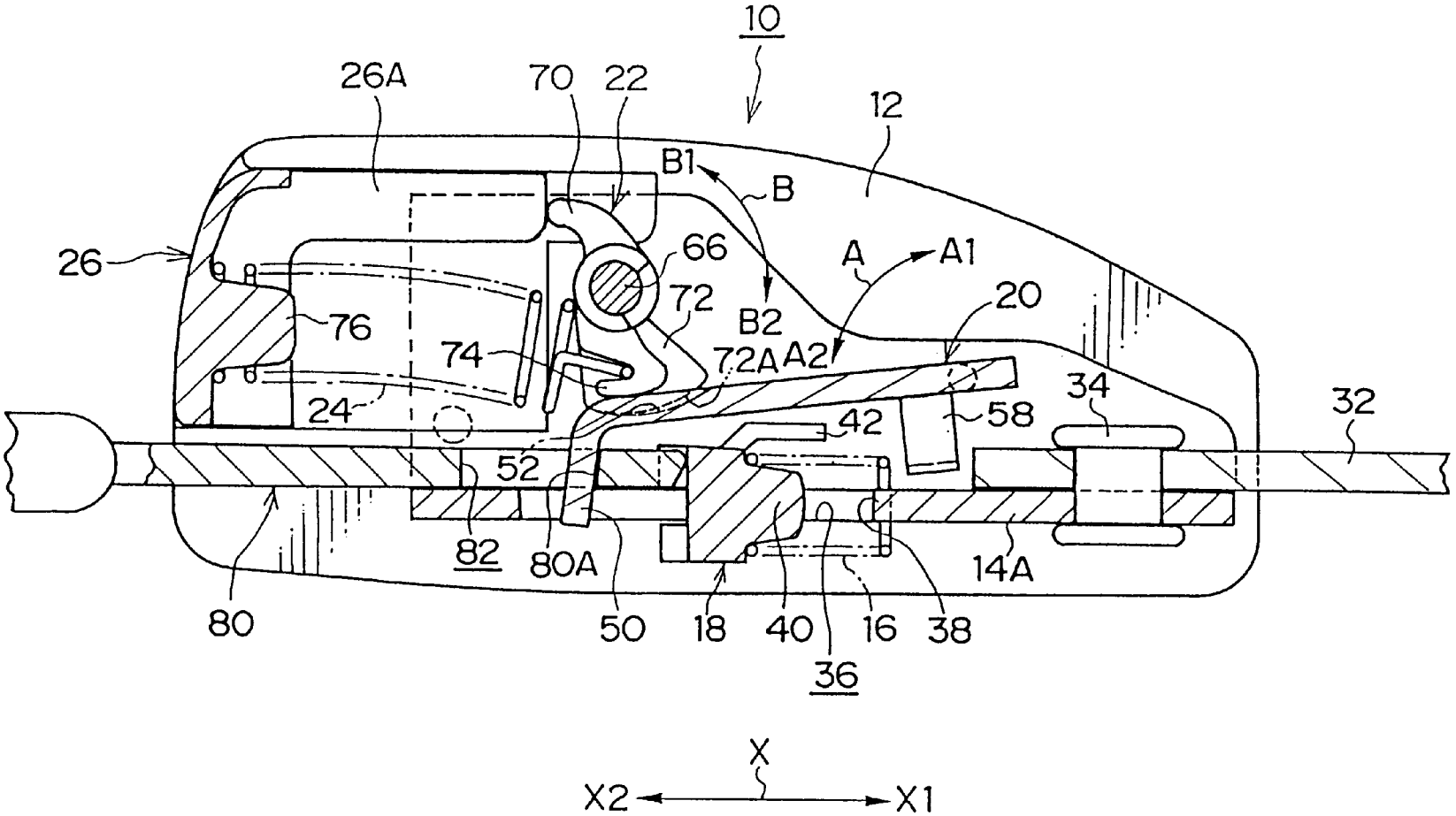
FIG. 3 is a cross-sectional view of main portions at a time the buckle relating to the embodiment of the present invention is latched.

Because the lock plate 20 separates from the cam 22 due to the lock plate 20 rotating in the A2 direction, the cam 22 which is always urged in the X1 direction by the return spring 24 rotates counterclockwise (the arrow B1 direction, hereinafter referred to as the B1 direction). The rotation of the cam 22 stops due to the claw 70 abutting the protrusions 26A of the release button 26. As a result, as illustrated in FIG. 3, the presser members 72 (presser surfaces 72A) of the cam 22 abut the receiving surfaces 52 of the lock plate 20, and clockwise (A1 direction) rotation of the lock plate 20, i.e., releasing of the latched state, is prevented.

Next, the case in which the tongue plate 80 is pulled out will be described with reference to FIGS. 3 and 4.

In this case, first, the release button 26 is pressed-in in the X1 direction. In this way, the protrusions 26A of the release button 26 press the claw 70 of the cam 22, and the cam 22 is rotated clockwise (in the arrow B2 direction, hereinafter referred to as the B2 direction) while compressing the return spring 24. Namely, the presser members 72 (presser surfaces 72A) of the cam 22 which were locking the lock plate 20 separate from the receiving surfaces 52 of the lock plate 20.

Figure 5:
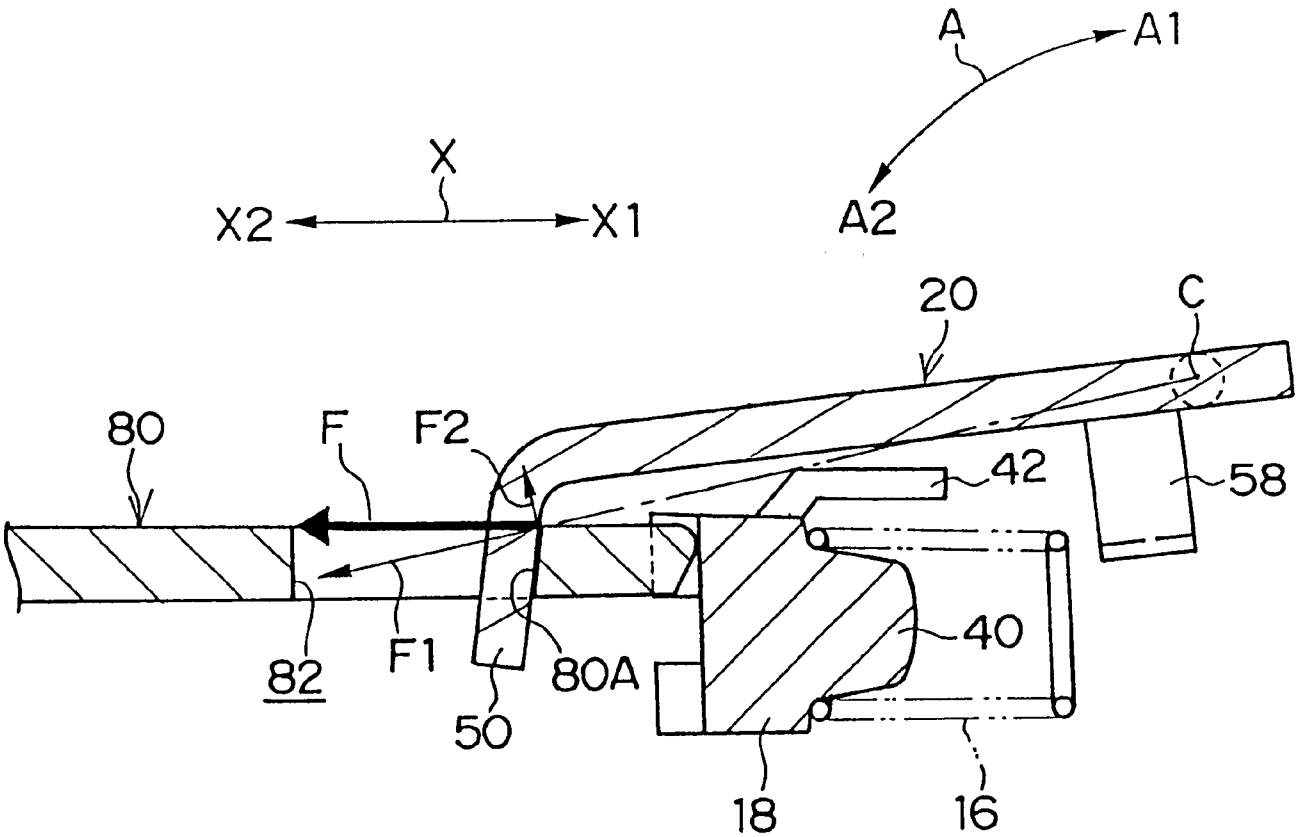
FIG. 5 is a schematic view for explaining application of force at a time a lock plate relating to the embodiment of the present invention releases a latched state.

As illustrated in FIG. 5, at the lock plate 20, X1 direction force F applied by the ejector spring 16 is applied to the engaging portion 50 from an X1 direction end surface 80A forming the engaging hole 82 of the tongue plate 80. This force F is dispersed into a force F1, which is a radial direction component which is disposed on a line connecting a center of rotation C (supporting members 56) of the lock plate 20 and the point of application of force, and a force F2 which is a component in a direction orthogonal to the force F1. Due to the force F2, a rotational moment in the A1 direction around the supporting plates 56 is applied to the lock plate 20.

Accordingly, due to the presser surfaces 72A of the cam 22 separating from the receiving surfaces 52 of the lock plate 20, the lock plate 20 is rotated in the A1 direction. As a result, the engaging portion 50 comes out from the engaging hole 82 of the tongue plate 80. In this way, the tongue plate 80, which was urged in the X2 direction by the ejector 18, is released from the buckle 10 in the X2 direction.

On the other hand, when the amount of compression of the return spring 24 exceeds a predetermined amount, the release button 26 returns to its original position (moves in the X2 direction) due to the elastic force of the return spring 24.

At the buckle 10 of the present embodiment, the cam 22, which maintains the latched state of the lock plate 20, is maintained at a predetermined position due to the elastic force of the return spring 24, and the return of the release button 26 to its original position also occurs due to the elastic force of the return spring 24. Namely, due to the return spring 24 being used for these two operations, the number of parts can be reduced.

Figure 6:
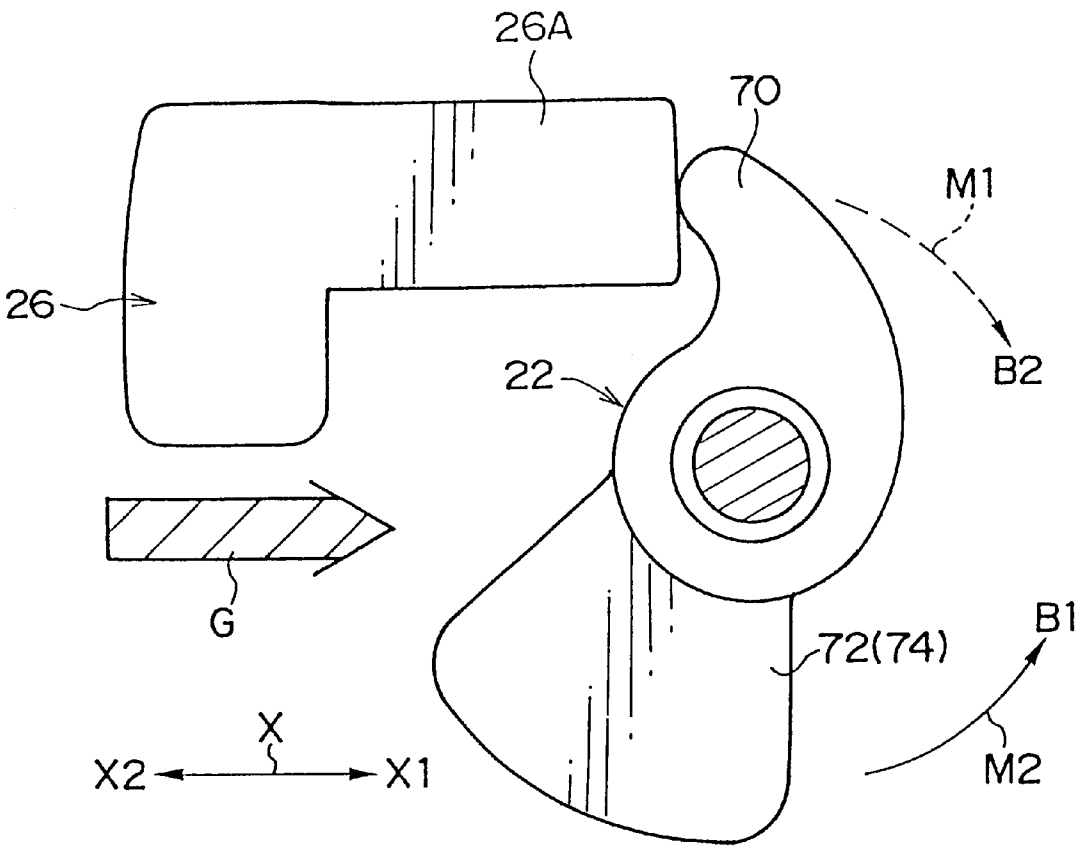
FIG. 6 is a schematic view for explaining a state in which force is applied to a cam relating to the embodiment of the present invention.

As illustrated in FIG. 6, in a case in which an impact force G is applied in the X1 direction when the buckle 10 is in a latched state, the X1 direction force is applied to the release button 26 and the claw 70, a rotational moment M1 in the B2 direction acts on the cam 22, and simultaneously, a rotational moment M2 in the B1 direction acts on the presser members 72 and the hook 74. Accordingly, if the weight of the presser members 72 and the hook 74 of the cam 22 is made sufficiently large, the rotational moment M2 is greater than the rotational moment M1. Namely, if the center of gravity of the cam 22 is positioned at the side of the presser members 72 and the hook 74 with respect to the center of rotation, even if the impact force G is applied to the cam 22, only the B1 direction rotational moment is applied. Accordingly, movement of the cam 22 in the B2 direction and releasing of the latched state due to the impact force G can be reliably prevented.

This can be achieved by, for example, forming a configuration in which the center of gravity at the cam 22 is positioned at the presser members 72 and hook 74 side, or by forming the cam 22 from a sintered alloy or the like whose relative mass is large.

Further, by sufficiently guaranteeing the weight of the cam 22 (the presser members 72 and the hook 74), even if the weight of the release button 26 formed from plastic or the like is added, the releasing of the latched state due to the impact force G can be reliably prevented.

In the first aspect of the invention, the number of parts of the buckle can be reduced while maintaining a structure in which the latched state can be maintained.

In the second aspect of the invention, the latched state can be even more reliably maintained while the number of parts is reduced.

What is claimed is:

1. A buckle which engages with a tongue plate provided at a webbing in a seat belt device, comprising:

a latch member engaging with the tongue plate which has been inserted to a predetermined position, and having follower surfaces;

a lock member, which is a freely rotating cam, slidably engaging said follower surfaces of said latch member and maintaining an engaged state in which said latch member is engaged with the tongue plate;

an operation member which, when operated, releases said lock member from said latch member; and a spring disposed between said operation member and said lock member, and urging said operation member to a pre-operation original position, and urging said lock member toward said latch member.

2. A buckle according to claim 1, wherein said lock member comprises:

a first convex portion pushed in a lock releasing direction by operation of said operation member; and a second convex portion formed at a side of a center of rotation of said cam which is substantially opposite the side at which said first convex portion is disposed, an end of said spring engaging with said second convex portion, wherein a center of gravity of said cam is positioned toward said second convex portion.

* * * * *

UNITED STATES PATENT AND TRADEMARK OFFICE

CERTIFICATE OF CORRECTION

PATENT NO. : 6,367,129 B1
DATED : April 9, 2002
INVENTOR(S) : Shinji Mori

It is certified that error appears in the above-identified patent and that said Letters Patent is hereby corrected as shown below:

Title page,
Item [56], References Cited, correct U.S. Patent "5,288,090" to read -- 5,286,090 --.

Signed and Sealed this

Nineteenth Day of November, 2002

*Attest:*

*Attesting Officer*

JAMES E. ROGAN
*Director of the United States Patent and Trademark Office*